US008092150B2

(12) United States Patent
Rofka et al.

(10) Patent No.: US 8,092,150 B2
(45) Date of Patent: Jan. 10, 2012

(54) GAS TURBINE WITH AXIAL THRUST BALANCE

(75) Inventors: Stefan Rofka, Nussbaumen (CH); Rene Waelchli, Niedergoesgen (CH); Sven Olmes, Villigen (CH); Thomas Zierer, Ennetbaden (CH)

(73) Assignee: Alstom Technology Ltd., Baden (CH)

( * ) Notice: Subject to any disclaimer, the term of this patent is extended or adjusted under 35 U.S.C. 154(b) by 982 days.

(21) Appl. No.: 12/167,800

(22) Filed: Jul. 3, 2008

(65) Prior Publication Data

US 2009/0067984 A1 Mar. 12, 2009

(30) Foreign Application Priority Data

Jul. 4, 2007 (CH) ..... 1079/07

(51) Int. Cl.
*F01D 3/00* (2006.01)
*F01D 3/04* (2006.01)

(52) U.S. Cl. ..... 415/104; 415/1

(58) Field of Classification Search ..... 415/1, 93, 415/94, 101, 115, 104; 416/31, 43, 365
See application file for complete search history.

(56) References Cited

U.S. PATENT DOCUMENTS

| | | | | |
|---|---|---|---|---|
| 2,647,684 | A | 3/1948 | Lombard | |
| 3,704,077 | A * | 11/1972 | Meyers et al. | 416/30 |
| 3,989,410 | A | 11/1976 | Ferrari | |
| 4,018,045 | A * | 4/1977 | Greune et al. | 60/39.281 |
| 4,653,267 | A | 3/1987 | Brodell et al. | |
| 4,730,977 | A | 3/1988 | Haaser | |
| 5,189,874 | A | 3/1993 | Kreitmeier | |
| 5,575,617 | A | 11/1996 | Marmilic | |
| 5,735,666 | A | 4/1998 | Johnston | |
| 5,760,289 | A | 6/1998 | Skottegard | |
| 6,422,809 | B1 | 7/2002 | Filippov | |
| 2005/0129507 | A1 | 6/2005 | Friedl | |
| 2010/0158668 | A1 * | 6/2010 | Ottaviano et al. | 415/104 |
| 2010/0287905 | A1 * | 11/2010 | Shepler | 60/39.24 |

FOREIGN PATENT DOCUMENTS

| | | | |
|---|---|---|---|
| CH | 246779 | A | 1/1947 |
| EP | 0447886 | A1 | 9/1991 |
| EP | 0702129 | A2 | 3/1996 |
| EP | 1541803 | A2 | 6/2005 |
| GB | 2200410 | A | 8/1998 |

* cited by examiner

*Primary Examiner* — Sheila V Clark
(74) *Attorney, Agent, or Firm* — Volpe and Koenig, P.C.

(57) ABSTRACT

A method for axial thrust control of a gas turbine, and a gas turbine with a device for controlling axial thrust are provided. A gas turbine, with regard to aerodynamic forces and pressure forces, which exert an axial force upon the rotor, is configured such that at no-load and low partial load it has a negative thrust, and at high load it has a positive thrust. In order to ensure a resulting positive thrust upon the thrust bearing within the entire load range of the gas turbine, an additional thrust is applied in a controlled manner. The additional thrust for example can be controlled in dependence upon the gas turbine load. The resulting thrust force at full load is consequently less than in the case of a conventionally designed gas turbine without thrust balance.

15 Claims, 3 Drawing Sheets

GAS TURBINE WITH AXIAL THRUST BALANCE

FIELD OF INVENTION

The invention relates to a method for operating a gas turbine with axial thrust balance, and also to a gas turbine with a device for implementing the method.

BACKGROUND

The axial thrust of a gas turbine is the resulting force from aerodynamic forces and pressure forces which exert an axial force upon the rotor in the compressor and turbine, and also all pressure forces which act upon the rotor in the axial direction. The resulting thrust is absorbed by a thrust bearing. Gas turbines are typically designed so that they have a minimum thrust at no-load. The axial thrust increases in proportion to the load. In order to balance the axial thrust, an opposing force to the thrust balance can be applied to the axial thrust which increases with the load. Consequently, the maximum thrust which is to be absorbed by the thrust bearing can be reduced. The overall dimension and the power loss of the thrust bearing can be correspondingly reduced.

The thrust of turbines and compressors, and also the pressure forces which act upon the rotor in the axial direction, are determined by operating parameters, especially by the position of compressor stator blades and compressor discharge pressure, and also by the design. In this case, it is determined by the selected geometries, especially by the geometries of the blade passages and by the reaction degrees of the turbine stages. The operating parameters are dependent upon the desired process and operating concept of the gas turbine. The load-dependence of the thrust can no longer be changed once a design is selected.

The problem of thrust balance in gas turbines has been known for a long time and a large number of solution approaches were proposed in literature. In particular, different ways are known of balancing the axial thrust via pressure balance cylinders, and therefore of reducing the load upon the thrust bearing. Different methods have also been developed for controlling the thrust control by an opposing force in a gas turbine.

In U.S. Pat. No. 5,760,289, for thrust balance it is proposed to provide a balance piston downstream of the turbine and to apply compressed air to this pressure balance piston. A complex algorithm is required in order to control the pressure in the balance piston, and consequently to control the balancing force, independently of the operating state. Furthermore, a periodic calibration of the algorithm is proposed in order to compensate aging or possible modifications to the gas turbine.

Another embodiment of a pressure balance piston is represented in U.S. Pat. No. 4,653,267. In this case, the pressure balance piston in the center part, that is to say in the section which is located between compressor and turbine, is constructed as a twin-shaft arrangement. The axial force of the piston during normal operation is reduced by a second chamber which is exposed to pressure application with leakage air. Air can be discharged from this second chamber via a valve and as a result the pressure level in this chamber can be reduced. By changing the pressure level in the second chamber, the resulting axial force of the pressure balance piston is controlled. The advantage of this arrangement is that the air which is discharged for controlling from the second chamber can be reused for turbine cooling.

For the two proposals, additional constructional parts are needed for producing the pressure balance piston. For example casing components, shaft cover, turbine disks or turbine rings are understood as structural components in this case. Furthermore, compressed air, without output, is lost from the pressure balance piston via seals, or can only be used at a considerably lower pressure level. For accommodating the pressure balance piston, moreover, expensive installation space is taken up and, especially in the case of embodiments according to U.S. Pat. No. 5,760,289, an extension of the axis becomes necessary.

Another approach for reduction of the axial forces is set out in EP0447886. In the gas turbine design which is represented there, in which the shaft section which lies between the turbine and the compressor is a drum which is enclosed by a drum cover, and in which the annular passage which is formed between drum and drum cover undertakes the guiding of the cooling air which is tapped from the compressor to the end face of the turbine rotor, a considerable portion of the axial forces is applied as a result of the pressure on the first turbine disk. In EP0447886, the axial force is reduced by the static pressure being reduced upstream of the end face of the turbine rotor. This is achieved by cooling air inside the annular passage on the rotor side being deflected through a swirl cascade and being accelerated to the highest possible tangential velocity in the rotational direction of the rotor. In addition to the advantages of this embodiment, which are represented in EP0447886 itself, in comparison to the use of pressure balance pistons it is to be noted that no additional structural components or additional axial constructional length are required for the construction of a pressure balance piston. Furthermore, no compressed air is lost via pressure balance pistons. In the case of this embodiment, however, there is no way of controlling the axial thrust. This has the result that a considerable residual thrust is to be absorbed via the thrust bearing at full load or, at low load, that a thrust reversal is to be taken into consideration. Depending upon design and arrangement of the thrust bearing, increased vibrations can occur during a thrust reversal and in the most unfavorable case, at even lower load, an overloading of the counter-bearing can occur. Furthermore, with this design in the case of modifications to the gas turbine which have an influence upon the thrust, such as an upgrade as a result of a new compressor or a new turbine, no ways are provided of balancing this altered thrust.

SUMMARY

The invention relates to a method for operating a gas turbine with thrust balance. The method includes providing a gas turbine with a rotor that, with regard to aerodynamic forces and pressure forces which exert an axial force upon the rotor, is configured such that the forces at no-load and low partial load result in a negative thrust. The gas turbine is also configured such that the forces at high load and full load result in a positive thrust. The method also includes applying a positive additional thrust in a controlled manner, for maintaining a positive resulting axial bearing force within an entire load range. In the high load range, no compressed air for pressure application is consumed.

BRIEF DESCRIPTION OF THE DRAWINGS

The invention is schematically represented in FIGS. 1 to 4 based on exemplary embodiments.

In the drawings.

DETAILED DESCRIPTION OF THE PREFERRED EMBODIMENTS

Introduction to the Embodiments

Figure 1:
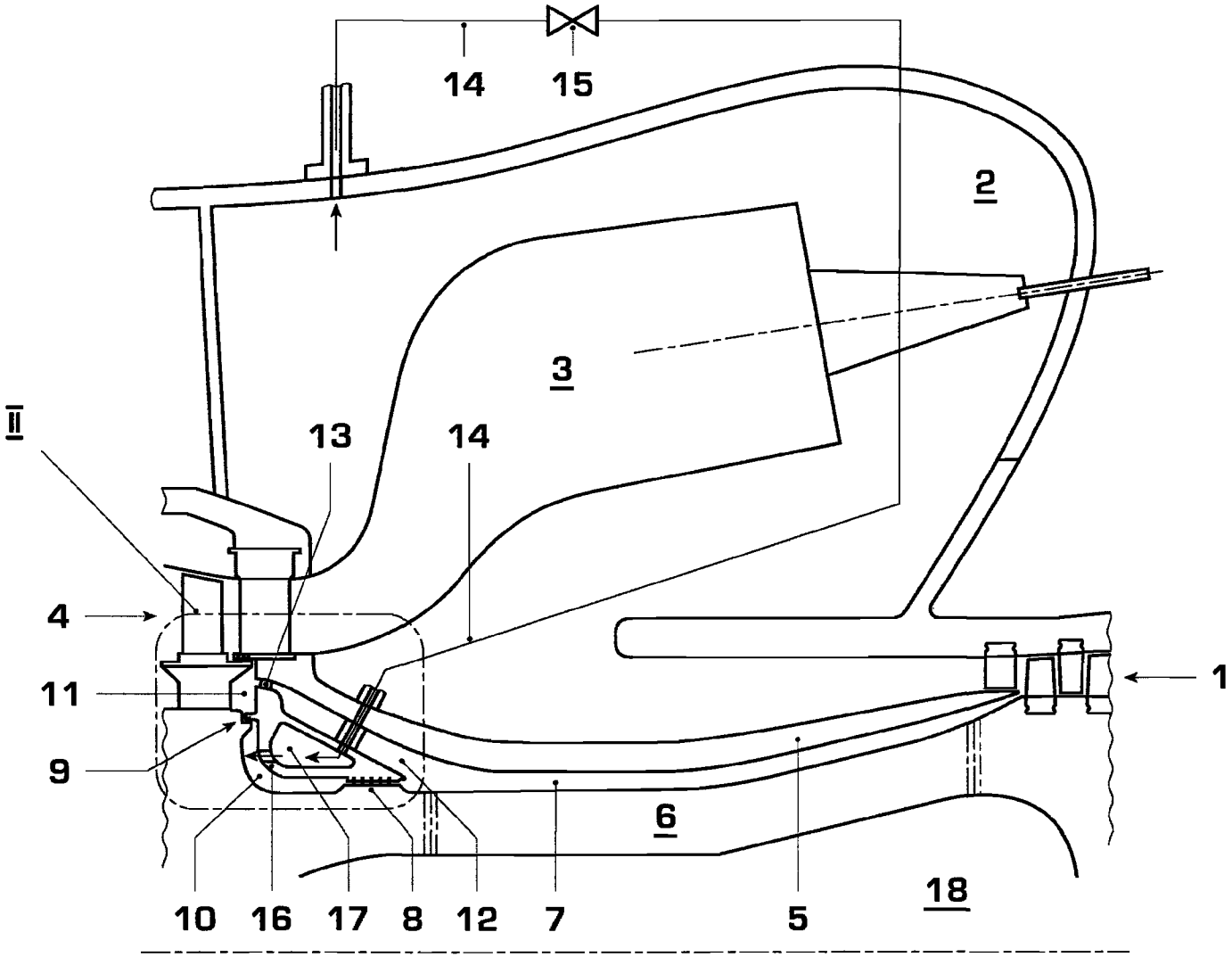
FIG. 1 shows a section through the center part of a gas turbine with inner and outer annular chamber, and also a feed for exposure of the inner annular cavity to pressure application.

The present invention is directed to creating a controllable thrust balance in gas turbines without using additional structural components, which at high load and especially at the design point does not result in additional cooling air consumption for exposing pressure balance pistons or similar to pressure application. Furthermore, the controllable thrust balance is to be retrofitted in gas turbines which have a center part which is constructed in accordance with EP0447886.

To achieve this, a gas turbine according to the invention with regard to aerodynamic forces and pressure forces, which exert an axial force upon the rotor, is designed so that at no-load and low partial load it has a negative thrust. A negative thrust is a thrust which points from the turbine in the direction of the compressor. In addition, it is designed so that it has a positive thrust at high gas turbine loads and especially at full load. In order to ensure a resulting positive force upon the at least one thrust bearing within the entire load range of the gas turbine, an additional thrust is applied in a controlled manner in the main thrust direction at no-load and partial load, that is to say a positive thrust is applied in the direction from the compressor to the turbine.

The resulting maximum thrust force which is to be absorbed by the at least one thrust bearing is consequently less than in the case of a conventionally designed gas turbine without thrust balance. Furthermore, by the additional thrust a thrust reversal during loading or unloading of the gas turbine is prevented. The load range in which an additional thrust is applied for example lies within the range of no-load up to about 60% full load. In the case of a gas turbine which is optimized for full load operation, the partial load range in which an additional thrust is applied for example can extend to about 90% full load. In the case of a retrofit, the partial load range in which additional thrust is applied, for example can only extend to about 10% full load.

The additional thrust is produced by a method for controlling the pressure on the end face or on a partial area of the end face of the turbine rotor. For this purpose, an essentially annular cavity between drum cover and first turbine disc, which is sealed by a rotor seal and a turbine blade root seal, is divided by a seal into an outer and an inner annular cavity. For example, the turbine rotor is supplied with high-pressure cooling air from the outer annular cavity, which cooling air is fed into this annular cavity at a highest possible tangential velocity. In the process, the static pressure in the outer annular cavity lies significantly below compressor pressure as a result of the sharp acceleration to the highest possible tangential velocity. For the acceleration of the cooling air to a highest possible tangential velocity, for example a swirl nozzle is used. However, for example oriented holes can also be used for the acceleration in the tangential direction.

With the control valve closed, if no additional compressed air is fed into the inner annular cavity, the ratio of the pressure drop across the rotor seal and turbine disk seal is inversely proportional to the ratio of the equivalent areas of the two seals. The rotor seal typically has a significantly smaller equivalent area than the turbine disk seal. The pressure drop across the rotor seal is correspondingly much greater than that across the turbine disk seal. The pressure in the inner annular cavity, therefore, with the control valve closed, is determined essentially by the pressure in the outer annular cavity.

In order to create an additional thrust in the main thrust direction, the inner annular cavity is exposed to pressure application with compressed air via at least one line from the compressor plenum or from another suitable tapping point. At least one control valve is provided for controlling the pressure application. As a result of the pressure application, an additional force is applied in the main thrust direction so that within the entire operating range of the gas turbine a positive resulting thrust upon the at least one thrust bearing is ensured and a thrust reversal is avoided.

The lower the static pressure is in the annular cavity with the control valve closed, the greater becomes the control range of the additional thrust force when using compressor end air. The aforementioned lowering of the static pressure by feeding the cooling air via a swirl nozzle therefore leads to an increase of the control range.

For pressure application, for example externally fed compressed air or steam can also be used, or an externally fed medium in combination with compressor air can be used.

In addition to using existing structural components, the advantage of this method lies in that no additional pressure application is necessary in the high load range, and as a result no compressed air is consumed at the cost of power and efficiency. Even if the pressure application is active at partial load, the air which escapes via the seal between inner and outer annular chambers is profitably admixed with the rotor cooling air.

For controlling the pressure application, different methods are conceivable. For example, the at least one control valve can be opened at low load and closed upon exceeding a discrete limiting value. By the same token, the at least one control valve is opened again upon falling short of the discrete limiting value. In order to avoid continual switching of the at least one control valve at loads close to the limiting value, a hysteresis can be provided.

Another way of controlling, for example, is closing the control valve in proportion to the load.

In a further control system, the position of the control valve is not preset in dependence upon the load but the pressure ratio between inner annular cavity and compressor end pressure is preset and this ratio controlled via the control valve. In this case, the target value is not necessarily constant but for example is a function of the load. The function for example can be determined so that a constant axial thrust is achieved over a widest possible operating range.

The position of the control valve or the target value of the pressure ratios inside the annular cavity for example can also be provided in dependence upon the compressor intake guide vane angle or upon the relative load.

Control systems in dependence upon combinations of parameters or further relevant parameters are also possible.

In addition to the application of the method for the design and development of new plants, the application in conjunction with the upgrade of a gas turbine is a special case. When upgrading a gas turbine, a reduction of the axial thrust can occur as a result of change to one of the principle components which are the turbine or compressor. This will be the case, for example, if, as a result of a compressor upgrade with practically unaltered intake mass flow and therefore practically unaltered compressor discharge pressure and turbine thrust, the compressor thrust increases. As a result of the increase of compressor thrust, a thrust reversal can occur after the upgrade. In order to avoid this, the method according to the invention can be used and a controlled additional thrust can be applied.

In addition to the method, a gas turbine with reduced maximum axial thrust, which is characterized by at least one partial area of the turbine rotor which can be exposed to pressure application, is the subject of the invention.

One embodiment is a gas turbine with a seal which divides the essentially annular cavity between drum cover and first turbine disc into an outer and an inner annular cavity. It is provided with at least one line from the compressor plenum to the drum cover, at least one control valve in this line, and at least one inlet into the inner annular cavity. There are different ways, which are known to the person skilled in the art, of constructing a seal between the end face of the turbine rotor and drum cover. A labyrinth seal is an example of a suitable seal.

In the case of a gas turbine with more than one turbine, annular cavities are divided for the pressure application on the end face of at least one turbine, or in combination with a plurality or all the turbines, and are constructed with at least one controllable compressed air supply.

Different ways are also known for inlet of the compressed air into the inner annular cavity. This for example can be a hole through the drum cover. In a further exemplary embodiment, the inlet into the inner annular cavity of the drum cover is an essentially annular plenum which is connected to the inner annular cavity by a multiplicity of openings.

In a further embodiment, at least one pressure measuring device is also provided in the inner annular cavity and in the compressor plenum.

In a further embodiment, the at least one feed line for pressurizing of the inner plenum is not connected to the compressor plenum but is connected to another suitable tapping point for compressor air via at least one control value.

DETAILED DESCRIPTION

A gas turbine with a device for implementing the method according to the invention essentially has at least one compressor, at least one combustion chamber and at least one turbine which via at least one shaft drives the compressor and a generator.

FIG. 1 shows a section through the center part of a gas turbine, that is to say the region between compressor and turbine, and also the end stage of the compressor and the first stage of the turbine.

The compressor 1 compresses the air. The greatest part of the air is directed via the compressor plenum 2 into a combustion chamber 3 and mixed with fuel which is combusted there. From there, the hot combustion gases flow out through a turbine 4, performing work. Turbine 4 and compressor 1 are arranged on a common shaft 18, wherein the part of the shaft which is located between compressor 1 and turbine 4 is constructed as a drum 6.

After the last compressor blade, the high-pressure portion of the rotor cooling air is diverted with swirl imposed through an annular passage 7 between rotor drum 6 and drum cover 5, and via the rotor cooling air feed line 12 and a swirl cascade 13 is directed into an annular cavity between drum cover and a first turbine disc. This annular cavity is divided by a seal 9 into an inner annular cavity 10 and an outer annular cavity 11.

The outer annular cavity for example is delimited by the rear side of a drum cover 5, an inner platform, which faces the rotor 18, of a first turbine stator blade, a first turbine disk, and also the seal 9.

The inner annular cavity for example is delimited by the rear side of a drum cover 5, a seal 9, a first turbine disc, a rotor seal 8, and also the walls of a part of an annular passage 7 which lies downstream of a rotor seal 8.

Figure 2:
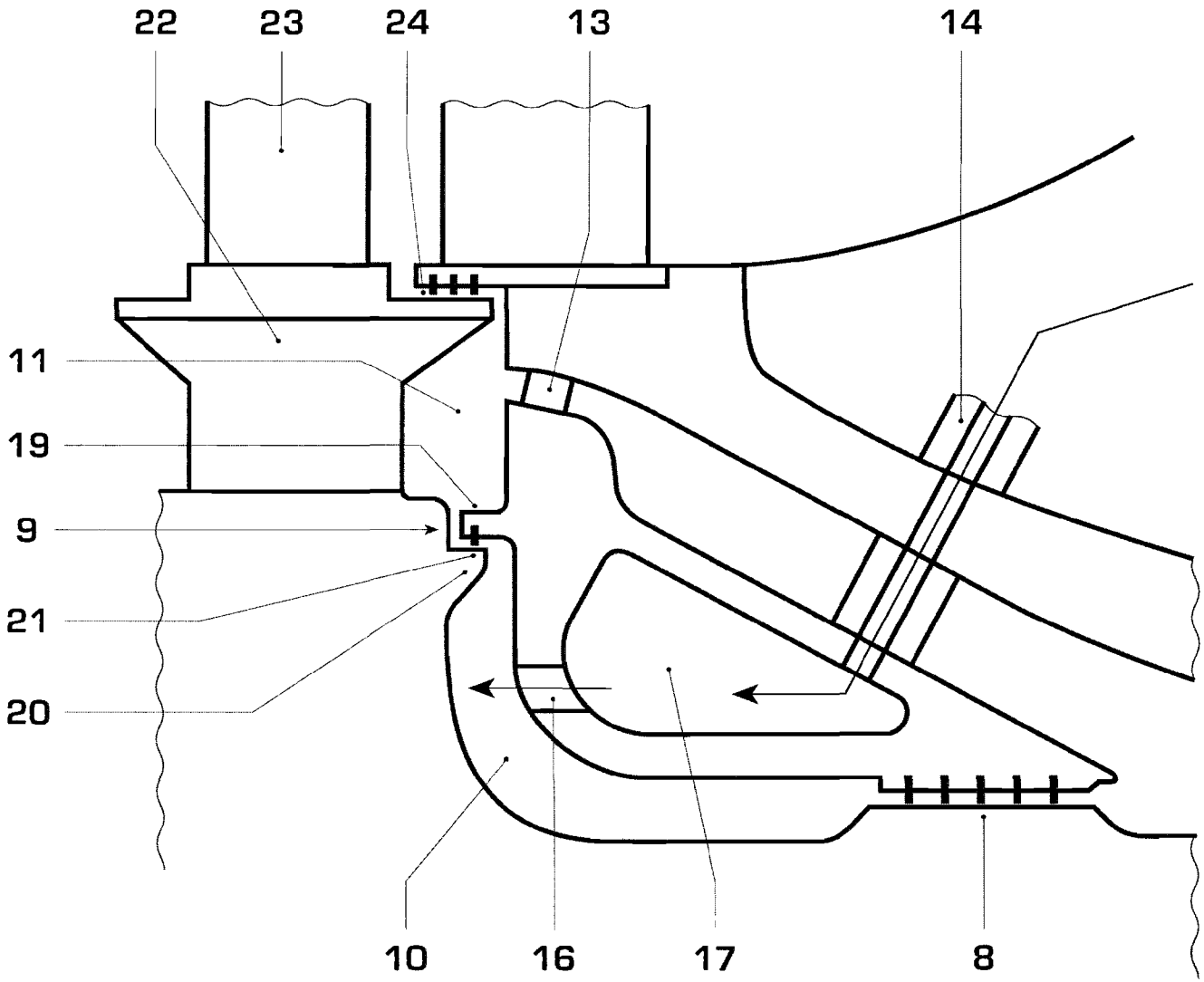
FIG. 2 shows a detail of the section of the center part for an embodiment of the turbine disc seal as a labyrinth seal.

The seal 9 for example can be constructed as a labyrinth seal 21. For accommodating the labyrinth seal 21, for example projections, which are offset in relation to each other and referred to as balconies, are provided on a drum cover 19 and on a first turbine disk 20, as shown in FIG. 2.

The rotor cooling feed 12 for example can be connected to an outer annular cavity 11 via a swirl cascade 13, which tangentially accelerates the rotor cooling air and as a result lowers the static pressure in an outer annular cavity 11. From the one outer annular cavity 11, the rotor cooling air enters a first turbine disc.

According to the invention, an annular cavity upstream of a first turbine disk, i.e. the essentially annular cavity between drum cover 5 and first turbine disk, which is sealed by a rotor seal 8 and a turbine blade root seal 24, is divided by a seal 9 into an inner 10 and outer annular cavity 11. This division allows the inner annular cavity 10 to be exposed to pressure application with compressed air from the compressor plenum 2 via a pressure line 14 and a control valve 15. The inlet 16 of the compressed air into the inner annular cavity 10 in this case can be carried out via holes through the drum cover, or, as shown in FIG. 1, via a plenum 17. In this case, the compressed air is fed via the at least one pressure line 14 into the plenum 17. From there, the compressed air reaches the inner annular cavity 10 via the inlet 16 which for example is constructed as a multiplicity of holes.

At partial load, for increasing the thrust force, the inner annular cavity 10 is exposed to pressure application via the pressure line 14 and the inlet 16 by opening the control valve 15. Via the turbine disk seal 9, this air, together with the leakage air of the rotor seal 8, reaches the outer annular cavity 11. A number of ways are provided of controlling the pressure application.

Figure 3:
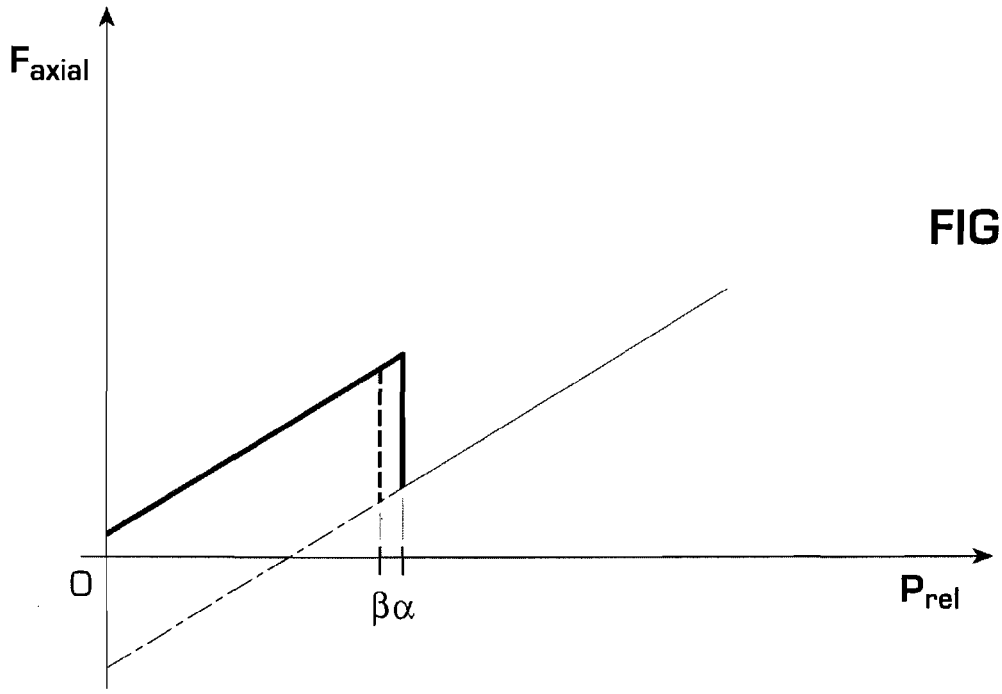
FIG. 3 shows thrust variation against load when controlling by a limiting value with hysteresis.

In FIG. 3, the resulting axial thrust for controlling in dependence upon the gas turbine load when controlling with a limiting value and hysteresis is shown. In this case, the control valve 15 is first opened at low load of the gas turbine. After exceeding a limiting value $\alpha$, the control valve is closed and remains closed in the upper load range (continuous line). With reduction of the load, upon falling below the load $\beta$, the control valve 15 is opened again (dashed line). Also, the thrust variation with thrust reversal, which would result without additional thrust in the lower load range, is represented by a dash-dot line.

Figure 4:
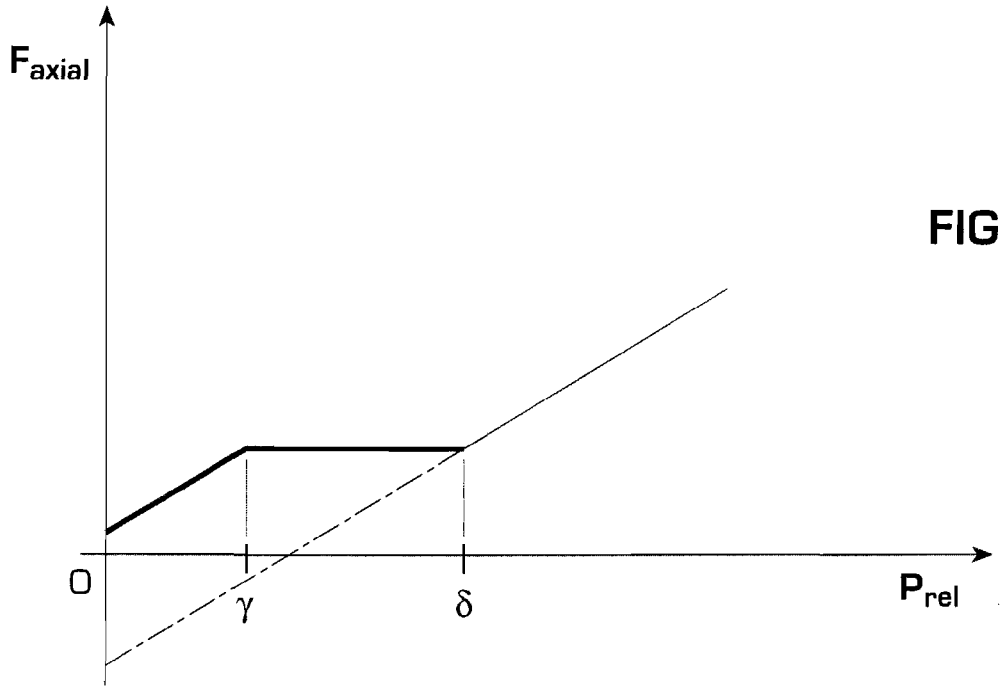
FIG. 4 shows an idealized thrust variation against load when controlling by the load-dependent pressure ratio between pressure in the inner annular cavity and compressor end pressure.

FIG. 4 shows the idealized thrust variation (continuous line) against gas turbine load when controlling by the load-dependent pressure ratio between pressure in the annular cavity and compressor end pressure. Also in this case, the control valve 15 is first opened at low load of the gas turbine. After achieving a target thrust, for example at load $\gamma$, the thrust is kept constant by changing the pressure in the inner cavity. Only when the control valve 15 is fully closed, which for example is the case at load $\delta$, does the thrust increase again in order to achieve its maximum value at full load. The dependence of the pressure ratio on load can be determined via model calculations or from tests and can be programmed in the gas turbine governor. Also, the thrust variation with thrust reversal, which would result without additional thrust, is represented by a dash-dot line.

Naturally, the invention is not limited to the embodiments which are shown and described here. For example the seals (8 and/or 9) can be constructed as a brush seal. All explained advantages can not only be applied in the respectively disclosed combinations, but can also be applied in other combinations or standing alone without departing from the scope of the invention.

LIST OF DESIGNATIONS

1 Compressor (only the two last stages are shown)
2 Compressor plenum
3 Combustion chamber
4 Turbine (only the first stage is shown)
5 Drum cover
6 Rotor drum
7 Annular passage
8 Rotor seal
9 Turbine disk seal
10 Inner annular cavity
11 Outer annular cavity
12 Rotor cooling air feed
13 Swirl cascade
14 Pressure line
15 Control valve
16 Inlet
17 Plenum
18 Shaft
19 Projection of the shaft cover
20 Projection of the first turbine disk
21 Labyrinth seal
22 Blade root
23 Rotor blade
24 Turbine blade root seal

What is claimed is:

1. A method for operating a gas turbine with thrust balance, comprising: providing a gas turbine with a rotor, that, with regard to aerodynamic forces and pressure forces which exert an axial force upon the rotor, is configured such that the forces at no-load and low partial load result in a negative thrust, and at high load and full load result in a positive thrust; and applying a positive additional thrust in a controlled manner, for maintaining a positive resulting axial bearing force within an entire load range, and in the high load range no compressed air for pressure application is consumed.

2. The method as claimed in claim 1, further comprising producing additional thrust for controlling the pressure on an end face, or on a partial area of the end face, of the turbine rotor.

3. The method as claimed in claim 2, further comprising dividing a substantially annular cavity between a drum cover and a first turbine disk by a seal into an outer annular cavity (11) and an inner annular cavity (10), and exposing one of the two cavities to pressure application for thrust control.

4. The method as claimed in claim 2, further comprising lowering the static pressure in the annular cavity, from which the turbine rotor is supplied with high-pressure cooling air, by imposing a swirl on the flow in the annular cavity.

5. The method as claimed in claim 3, wherein the outer annular cavity (11) is used for the cooling air supply of the turbine rotor, and the inner annular cavity (10) is used for thrust control.

6. The method as claimed in claim 1, further comprising at least one of the following for thrust control:

using compressed air from a compressor plenum (2);
using compressed air from a compressor tapping upstream of a compressor end;
using compressed air from an external source; or
using steam from an external source.

7. The method as claimed in claim 1, further comprising providing at least one control valve (15) to control thrust for pressure application; opening the control valve at low load; closing the at least one control valve upon exceeding a discrete limiting value; and reopening the at least one control valve upon falling below the discrete limiting value.

8. The method as claimed in claim 7, wherein the limiting value for opening the at least one control valve (15) is higher than the limiting value for closing.

9. The method as claimed in claim 7, wherein the at least one control valve (15) is closed in proportion to the load for adjusting the additional thrust.

10. The method as claimed in claim 3, further comprising establishing a preset pressure ratio, for controlling the additional thrust, between inner annular cavity (10) and compressor end pressure (2); and controlling the ratio by at least one control valve (15).

11. The method as claimed in claim 10, wherein the pressure ratio between inner annular cavity and compressor end pressure is a function of the load, or
a function of another relevant operating parameter, or a combination of operating parameters of the gas turbine.

12. A gas turbine with thrust balance comprising a rotor and at least one face, or partial area of the rotor, exposable to pressure application, the turbine, with regard to aerodynamic forces and pressure forces which exert an axial force upon the rotor, is configured such that the forces at no-load and low partial load result in a negative thrust, and at high load and full load result in a positive thrust, a control device for applying a positive additional thrust in a controlled manner, such that resulting axial bearing force is positively maintained within an entire load range, and in the high load range no compressed air for pressure application is consumed.

13. A gas turbine as claimed in claim 12, further comprising a substantially annular cavity between a drum cover and a first turbine disk is divided by a turbine disk seal (9) into an outer annular cavity (11) and an inner annular cavity (10), and one of the two cavities is the partial area of a turbine rotor exposable to pressure application.

14. A gas turbine as claimed in claim 13, further comprising at least one line (14) with control valve (15) from a compressor plenum (2), or from a compressor tapping point, and an inlet (16) into the substantially annular cavity exposable to pressure application.

15. A gas turbine as claimed in claim 14, further comprising at least one pressure measuring device for measuring pressure in at least one of the substantially annular cavity exposable to pressure application, or a compressor end.

* * * * *